US005231939A

United States Patent [19]

Tanaka et al.

[11] Patent Number: 5,231,939

[45] Date of Patent: Aug. 3, 1993

[54] APPARATUS FOR ESTIMATING AN UNBURNED COMPONENT AMOUNT IN ASH IN A COAL-FIRED FURNACE

[75] Inventors: Shinji Tanaka, Tokyo; Tatsuya Miyatake, Chiba; Kazuyoshi Yamamoto, Hyogo; Yuichi Miyamoto, Hyogo; Eiichi Harada, Hyogo, all of Japan

[73] Assignee: Kawasaki Jukogyo Kabushiki Kaisha, Kobe, Japan

[21] Appl. No.: 828,312

[22] Filed: Jan. 30, 1992

[30] Foreign Application Priority Data

Apr. 5, 1991 [JP] Japan ..... 3-71999

[51] Int. Cl.[5] ..... F23D 1/00

[52] U.S. Cl. ..... 110/347; 110/186; 110/188; 110/232

[58] Field of Search ..... 110/185, 186, 347, 188, 110/232

[56] References Cited

U.S. PATENT DOCUMENTS 4,528,918 7/1985 Sato et al. ..... 110/347
4,640,204 2/1987 Williams ..... 110/347

FOREIGN PATENT DOCUMENTS 0002527 1/1983 Japan ..... 110/186
0223425 10/1986 Japan ..... 110/186

*Primary Examiner*—Edward G. Favors
*Attorney, Agent, or Firm*—Schwartz & Weinrieb

[57] ABSTRACT

This invention relates to an in-ash unburned component estimating device for a coal-fired furnace which monitors the density of in-ash unburned component contained in burning waste gases to operate the furnace efficiently. The object of the invention is to infer and estimate from the current situation by a simple means the density of in-ash unburned component in the burning exhaust gases that affects the combustion efficiency. A furnace temperature, a load band in the furnace, a furnace contamination coefficient, a ratio of two-stage combustion air supplied to the furnace, and a coal mixture ratio are taken in as fuzzy quantities to infer fuel ratio data and correction data used to correct predetermined reference values of reference in-furnace temperature distribution, reference in-furnace air ratio distribution and reference powdered coal grain diameter distribution. The reference values corrected by the correction data and coal reaction rate data determined from the fuel ratio data are used to calculate the density of in-ash unburned components in the burning waste gases.

2 Claims, 4 Drawing Sheets

APPARATUS FOR ESTIMATING AN UNBURNED COMPONENT AMOUNT IN ASH IN A COAL-FIRED FURNACE

BACKGROUND OF THE INVENTION

1. Field of the Invention

The present invention relates to an apparatus for estimating the amount of unburned components in ash in a coal-fired combustion furnace, which monitors the density of in-ash unburned components contained in the burning waste gases to operate the combustion furnace efficiently.

2. Description of the Prior Art

In recent years, with coal having gained its position as a viable alternative energy to oil, a powdered coal burning technology for generator boilers is attracting attention. The technology itself is already an established one, in which the coal is pulverized by a pulverizing mill and the powdered coal, which is separated from coarse grains of coal by a fine/coarse grain separator, is injected in the form of a gas from a burner into a furnace for combustion.

FIG. 4 shows a schematic configuration of a generator boiler using the powdered coal combustion system. In the figure, the coal deposited in a charging mechanism 10 is fed to the pulverizing mill 11 where it is pulverized by rollers 12 to small grains which are separated by a fine/coarse grain separator 13 into coarse grains and fine grains of coal. Two types of fine/coarse grain separator are available: one is a vane type that separates fine grains from coarse grains by changing the angle of vanes and the other is a rotary type that utilizes centrifugal force in separating the fine from the coarse grains of coal.

The powdered fine grains of coal extracted by the fine/coarse separator 13 are fed together with primary air to a burner 15 of the furnace 14. The primary air serves two purposes—drying the powdered coal to make it easier to burn and carrying the powdered coal to the burner. The primary air accounts for 10–30 percent of the amount of air required for combustion. The remainder of the air is supplied as secondary air from around the nozzle of the burner 15. Tertiary air may be supplied to ensure stable ignition or adjust the shape of flame. From an appropriate position in the furnace 14 remote from the burner 15, air for a second-stage combustion (in a two-stage combustion method) is supplied in a direction of propagation of burning gas.

These kinds of air are supplied from a delivery air blower 16 through an air preheater 17, with the amount of second-stage combustion air adjusted by a second-stage air damper 18.

Heat generated by the furnace 14 is transmitted to water in an evaporator tube 19 by radiation or through contact with gases, evaporating the water. The burning gas is passed through the air preheater 17 where the heat of the burning gas is collected, and then discharged by a suction air blower 20 from a stack 21.

In operation of boiler, it is necessary to minimize the amount of noxious emissions from the burning gases such as nitrogen oxides $NO_x$ and sulfur oxides $SO_x$ within an allowable range while at the same time reducing the amount of in-ash unburned components ($H_2$, $CH_4$, etc.) that affect the combustion efficiency. Especially with those boilers using coal as a fuel, the rate of combustion is far slower than those of oil and gas and therefore reduces the temperature of the furnace, which in turn increases the amount of unburned substances ($H_2$, $CH_4$, etc.) in the ash. The temperature in the combustion furnace is also reduced by the two-stage combustion method, a method intended to reduce the $NO_x$ emissions.

The amount of unburned substances remaining in ash varies greatly depending on the size of coal grains burned by the burner 15. The finer the grain size, the greater the surface area will become through which the coal contacts the air for combustion and the smaller the amount of unburned components that remain in the ash. During boiler operation, it is therefore necessary to monitor the density of in-ash unburned components in the burning waste gases. When there is an increase in the unburned component density in the ash, the fine/-coarse grain separator 13 is controlled to extract finer grains of coal to increase the combustion efficiency.

Since the powdered coal combustion is affected by various factors such as fuel ratio, ash components in coal, and grain size distribution, it is very difficult to estimate the in-ash unburned components during the process of combustion. In an effort to make it less difficult to estimate the in-ash unburned components, a technique has been proposed (for example, Japanese Patent Preliminary Publication No. Heisei 2-208412) that provides to the wall of the combustion furnace an inspection window through which the burning flames of the burner are photographed by a camera. Based on the flame images thus obtained, flame temperatures are estimated, and from such data as the flame temperature, the amount of coal supplied, the amount of air supplied and the preheating air temperature, a combustion rate is determined. Using the combustion rate and the amount of ash in the coal, this technique estimates the density of the in-ash unburned components.

However, since, with this conventional technique, an analog video signal from the camera, which is installed on the wall of the combustion furnace, is converted into a digital video signal and digital images of flames are processed to calculate the flame temperature, the apparatus becomes complex. Calculation of the amount of the in-ash unburned components at the outlet of the combustion furnace requires data on temperature distribution and air ratio distribution in the course of combustion, in addition to the flame temperature. It is, however, difficult to measure the overall temperature distribution and air ratio distribution in the entire real combustion furnace.

OBJECT OF THE INVENTION

An object of the invention is to provide an in-ash unburned component estimating apparatus for a coal-fired combustion furnace that can determine by a simple means from the current combustion status the density of the in-ash unburned components in burning waste gases that affects the combustion efficiency.

SUMMARY OF THE INVENTION

In a powdered coal-fired combustion furnace, an apparatus of this invention is characterized in performing the steps of: taking in as fuzzy quantities an in-furnace temperature, a load band in the furnace, a furnace contamination coefficient, a ratio of two-stage combustion air supplied to the furnace, and a coal mixture ratio; inferring fuel ratio data and correction data used to correct predetermined reference values of reference in-furnace temperature distribution, reference in-furnace air ratio distribution and reference powdered coal grain size distribution; and based on the reference values corrected by the correction data and on coal reaction rate data determined from the fuel ratio data, calculating the density of in-ash unburned components in burning waste gases.

The in-ash unburned component estimating apparatus according to this invention treats as fuzzy quantities such data as a temperature in the combustion furnace, a load band in the combustion furnace, a furnace contamination coefficient, a ratio of two-stage combustion air supplied to the furnace and a mixture ratio of coals supplied to the furnace, qualitatively evaluates these fuzzy quantities with corresponding membership functions, searches through a group of fuzzy rules that predefine the outputs for specific situations to pick up a rule that matches the evaluated value, and then forms a fuzzy inference according to that rule to infer correction data for making adjustment on reference values of a reference in-furnace temperature distribution, a reference in-furnace air ratio distribution and a reference powdered coal grain diameter distribution and also infer fuel ratio data.

According to the correction data thus inferred, the reference values of the theoretically or empirically predetermined reference values of reference in-furnace temperature distribution, reference in-furnace air ratio distribution, and reference powdered coal grain distribution are corrected. From the fuel ratio data inferred, coal reaction rate data is determined. Then, based on the corrected reference values and the reaction rate data, the in-ash unburned component density is calculated.

BRIEF DESCRIPTION OF THE DRAWINGS

Various other objects, features, and attendant advantages of the present invention will become more fully appreciated from the following detailed description when considered in connection with the accompanying drawings, in which like reference characters designate like or corresponding parts throughout the several views, and wherein.

DETAILED DESCRIPTION OF PREFERRED EMBODIMENT

Figure 1:
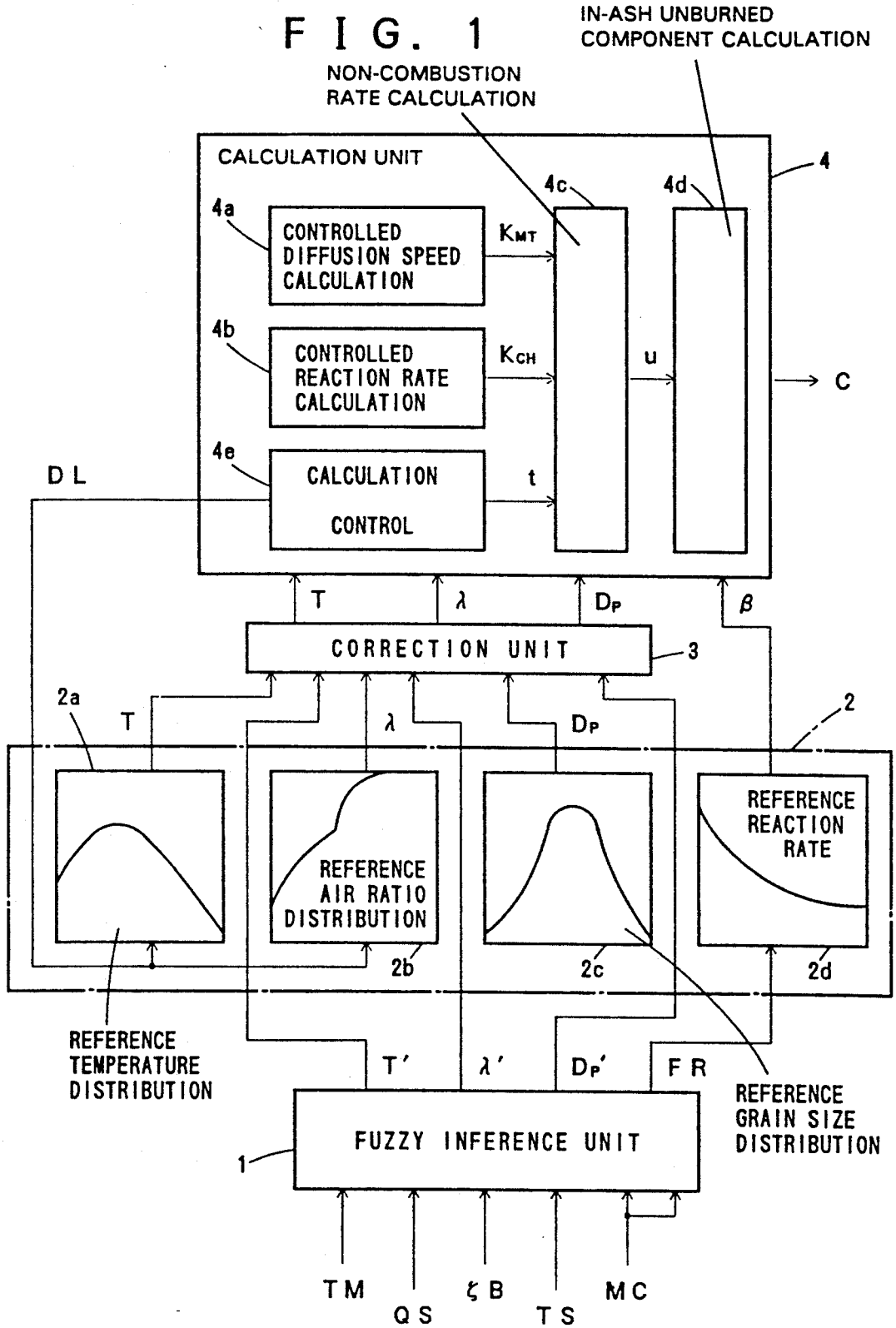
FIG. 1 is a block diagram of one embodiment of this invention.

FIG. 1 is a block diagram showing one embodiment of an in-ash unburned component estimating apparatus for a coal-fired combustion furnace according to this invention.

The apparatus consists of: a fuzzy inference unit 1 that takes in such data as a combustion furnace temperature TM, a load signal QS, a furnace contamination coefficient $\xi B$, a two-stage combustion air ratio TS and a coal mixture ratio MC and which infers correction values for an in-furnace temperature T, an in-furnace air ratio (ratio of ideal air amount and actual air amount) $\lambda$ and a powdered coal grain diameter $D_p$, and also a coal fuel quality ratio (between volatile component and solid carbon component) FR; a reference unit 2 that has reference distribution models which have been theoretically or empirically determined, such as a distribution of in-furnace temperature T, a distribution of in-furnace air ratio $\lambda$, a distribution of coal grain size $D_p$, and a distribution of reaction rate $\beta$ according to the coal quality; a correction unit 3 that corrects the reference values of the in-furnace temperature T, in-furnace air ratio $\lambda$, and powdered coal grain diameter $D_p$ obtained from the reference unit 2 according to the corresponding correction values obtained from the fuzzy inference unit 1; and a calculation unit 4 that calculates the in-ash unburned component density C from the values T, $\lambda$, $D_p$ corrected by the correction unit 3 and from the reaction rate $\beta$ output from the reference unit 2.

Figure 2:
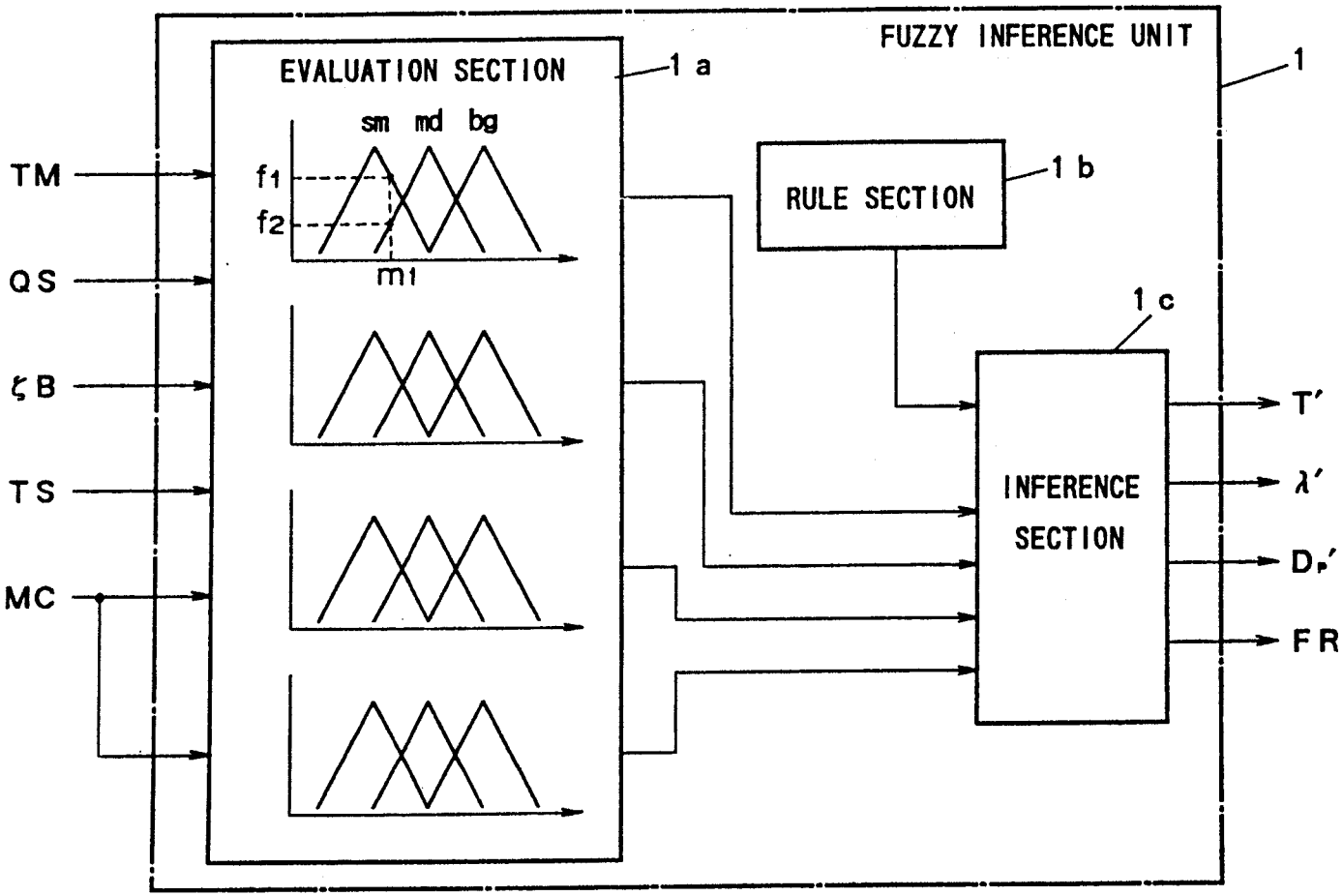
FIG. 2 is a block diagram of a fuzzy inference unit.

As shown in FIG. 2, the fuzzy inference unit 1 comprises an evaluation section 1*a*, a rule section 1*b*, and an inference section 1*c*. The evaluation section 1*a* takes in as fuzzy quantities such data as the in-furnace temperature data TM measured by a temperature sensor installed in the combustion furnace 14, the two-stage combustion air ratio data TS obtained from the control amount of the two-stage combustion air damper 18, and the mixture ratio MC of coals supplied to the mill 11 and then qualitatively evaluates these data with corresponding membership functions. The rule section 1*b* contains a number of rules that have been set up based on an abundant accumulated database and which define the outputs under specific situations. The rules are described in the form of a statement consisting of an IF portion (a leading part of the statement) and a THEN portion (a concluding part of the statement). The inference section 1*c* searches through the rule section 1*b* for a rule that matches the value evaluated by the evaluation section 1*a* and infers a correction value T' for the reference in-furnace temperature distribution T, a correction value $\lambda'$ for the reference in-furnace air ratio distribution $\lambda$ and a correction value $D_p'$ for the reference grain size distribution $D_p$ and also the fuel ratio FR.

Suppose the in-furnace temperature data TM is m1 and that there are three rules concerning the in-furnace temperature: "if TM=sm then T'=sm" (rule 1) "if TM=md then T'=md" (rule 2) and "if TM=bg then T'=bg" (rule 3). From the membership functions concerning the in-furnace temperature in the evaluation section 1*a*, the extent (the degree of fuzziness) f1, f2 to which the rules are satisfied can be determined.

Figure 3A:
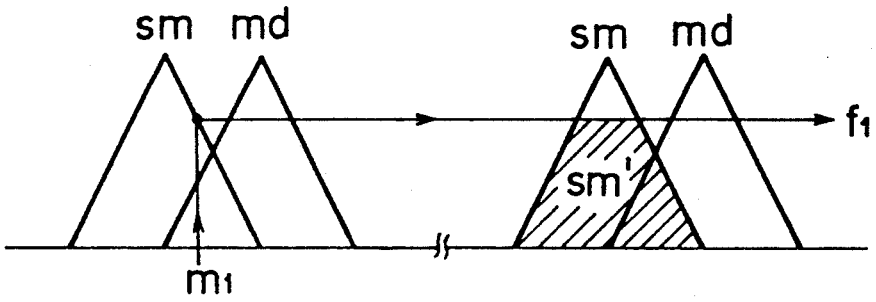
FIGS. 3*a*, 3*b* and 3*c* are diagrams showing the process of inference as performed by the fuzzy inference unit.
Figure 3B:
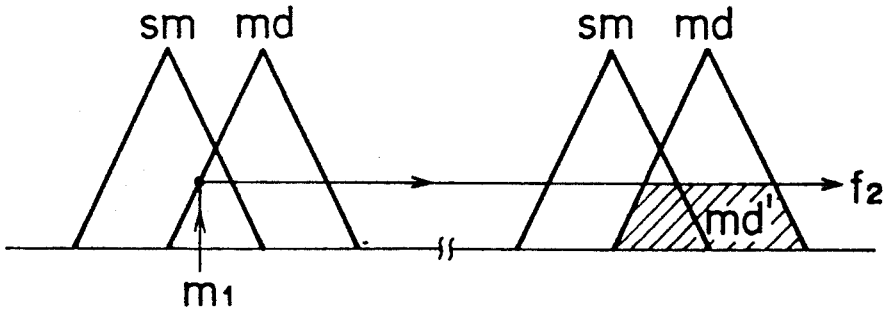
Figure 3C:
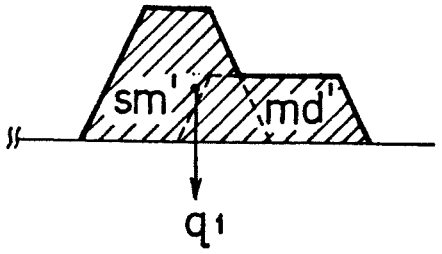
Figure 4:
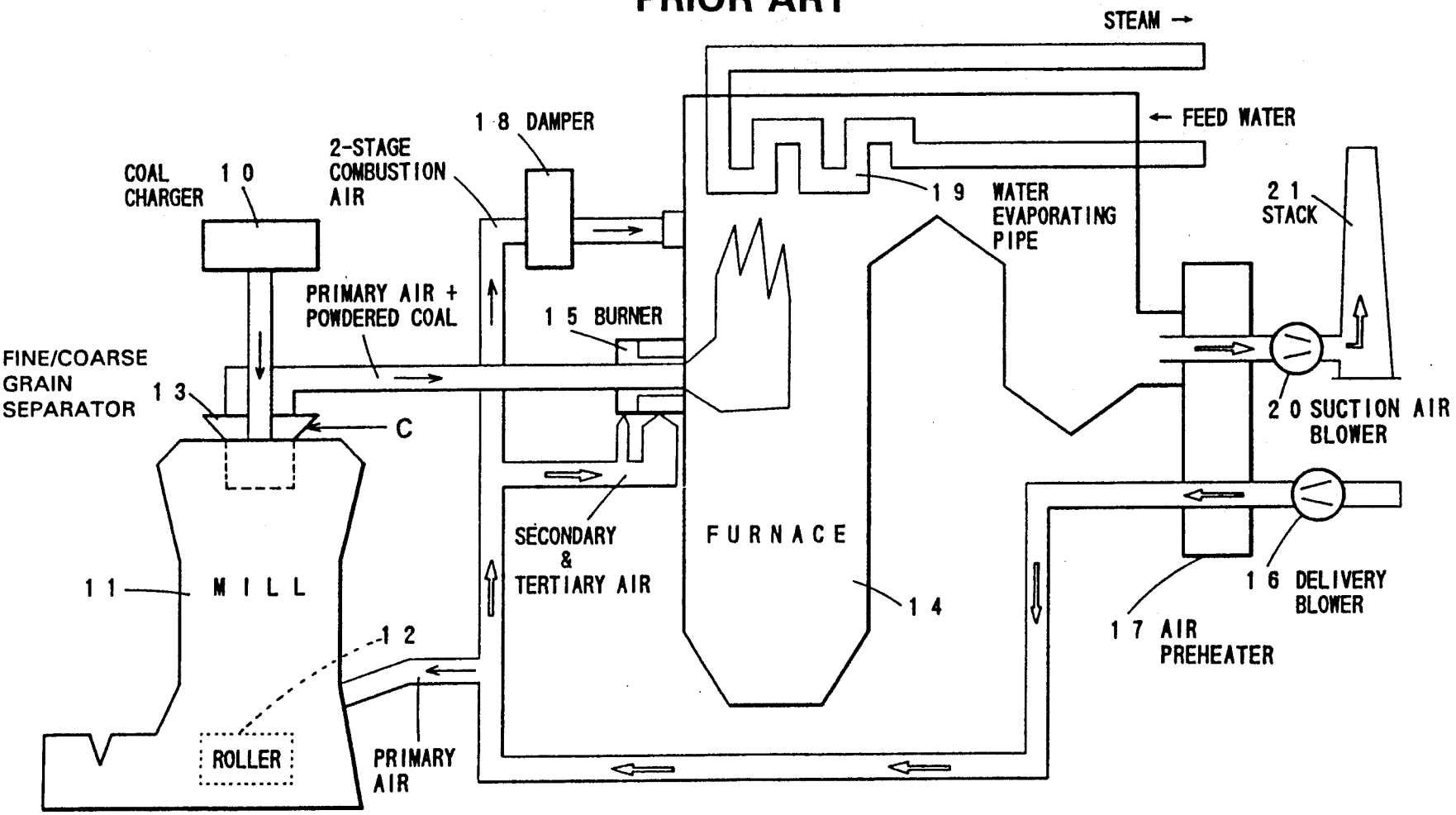
FIG. 4 PRIOR ART
FIG. 4 is a schematic showing the outline configuration of a generator boiler.

The inference section 1*c* uses a "max-min logical product" reasoning method and takes a logical product between a membership function with a flat fuzziness degree f1 for the rule 1 and a membership function of the concluding part of the statement "T'=sm." Likewise, a logical product is taken of a membership function with a flat fuzziness degree f2 for the rule 2 and a membership function of the concluding part of the statement "T'=md." This is detailed in FIGS. 3*a*, 3*b* and 3*c*. The membership functions of each concluding part of the statements are truncated to determine sm' (FIG. 3*a*) and md' (FIG. 3*b*). Then a logical summation is taken of sm' and md' and the center of gravity of the combined figure is determined (FIG. 3*c*) according to a center-of-gravity method. Now the value q1 of the gravity center in the combined set represents the final output T' (correction value for the in-furnace temperature T). The similar process is repeated to determine other outputs $\lambda'$, $D_p'$, FR. In the figure, the fuzzy labels "sm," "md," and "bg" stand for "small correction," "middle correction," and "big correction."

The reference unit 2 has a reference temperature distribution table 2a representing the distribution of in-furnace temperature T over the length DL of the furnace, a reference air ratio distribution table 2b representing the distribution of in-furnace air ratio λ over the furnace length DL, a reference grain size distribution table 2c representing the distribution of coal grain size $D_p$, and a reference reaction rate distribution table 2d representing the distribution of coal reaction rate β with respect to the fuel ratio FR that was inferred by the fuzzy inference unit 1. The data stored in these tables are predetermined theoretically or empirically. The furnace length DL is given by the calculation control section 4e.

The correction unit 3 corrects the reference data such as in-furnace temperature T, in-furnace air ratio λ and grain size $D_p$ output from the tables 2a, 2b, 2c in the reference unit 2 according to the corresponding correction values T', λ', $D_p'$ inferred by the fuzzy inference unit 1 and feeds the corrected data to the calculation unit 4. This configuration allows the rules to be expressed in an "if-then" form of statement which permits easy adjustment of correction utilizing the features of fuzzy reasoning. This configuration also enables the fuzziness of measured signals to be incorporated in the expression of rules. As to the in-furnace temperature, the correction calculation uses a rule in the form of addition and subtraction, considering deviations from the temperature distribution load band and from the contamination coefficient. As for the in-furnace air ratio and grain distributions, the correction calculation uses a rule in the form of multiplication.

The calculation unit 4 consists of: a controlled diffusion speed calculation section 4a that calculates from the data supplied from the reference unit 2 and the correction unit 3 the diffusion speed of oxygen $K_{MT}$ when the diffusion is controlled (chemical reaction rate is infinitely large); a controlled reaction rate calculation section 4b that calculates the surface reaction rate $K_{CH}$ when the surface reaction is controlled (diffusion speed is infinitely large); a non-combustion rate calculation section 4c that calculates the non-combustion rate u for the powdered coal; an in-ash unburned component amount calculation section 4d that calculates the density of in-ash unburned components C from the non-combustion rate u; and a calculation control section 4e that controls these calculations.

Generally, the combustion process of the powdered coal blown into the furnace consists of two stages: a first stage is for burning the gases of volatile components of coal and a second stage is for burning the surfaces of remaining solid grains of coal (char). Most of the combustion time is spent burning the char. The overall burning speed of the char depends on the diffusion speed of oxygen over the grain surface and on the chemical reaction rate of the grain surfaces. The former is related with the mixture ratio of fuel and air, while the latter is related not only with the chemical property of the fuel but also with the physical properties such as grain size of powdered coal and its motion.

The overall combustion speed of char dm/dt is, according to studies by Katakura and et al., given by $$dm/dt = -\pi D_p^2 \times 1/(1/K_{MT} + 1/K_{CH}) \quad (1)$$

where m represents the mass of particles, $D_p$ represents the diameter of particles, $K_{MT}$ represents the diffusion speed of oxygen, and $K_{CH}$ represents the surface reaction rate.

The diffusion speed $K_{MT}$ is calculated by the controlled diffusion speed calculation section 4a while the surface reaction rate $K_{CH}$ is calculated by the controlled reaction rate calculation section 4b. The diffusion speed $K_{MT}$ is given by $$K_{MT} = -\frac{48}{32}\,\frac{D_o\rho_o}{D_p}\,(T/T_o)^{0.75}\,\frac{\ln(1-\gamma f_m)}{\gamma} \quad (2)$$

where D is a diffusion coefficient of oxygen; ρ is a gas density, $D_p$ is a grain size; T is an in-furnace temperature; γ is a value determined by the diffusion coefficient and a quantum coefficient of combustion reaction; and $f_m$ is a mass fraction. The subscript "0" represents a standard status.

The reaction rate $K_{CH}$ is expressed as $$K_{CH} = K_{CH}' \times \beta = K_{CH}'\{1+(2/FR)^{1.5}\times 2\}/3 \quad (3)$$

where β is the reaction rate ratio described earlier and FR is the fuel ratio. $K_{CH}'$ represents the average surface reaction rate for a wide range of coals and differs from one coal quality to another. So $K_{CH}'$ is corrected by the reaction rate ratio β, which is determined by the fuel ratio FR representing the quality of coal. The average reaction rate $K_{CH}'$ is expressed as $$\begin{aligned} K_{CH}' &= 8710\exp(-17980/T)P_o\ (T \leqq 1500K) \\ &= (3.85\times 10^{-4}T - 0.525)\times P_o\ (T > 1500K) \end{aligned} \quad (4)$$

where $P_0$ is a partial pressure of oxygen (atm).

There is a relationship between the oxygen partial pressure $P_0$ and the reference air ratio distribution λ as follows.

$$P_0/P_{total} = V_{O2}/V_{total} = O_2\%$$

where $P_{total}$ is a total pressure (atm), $V_{O2}$ is a volume of oxygen, $V_{total}$ is a total volume, and $O_2\%$ is an oxygen density.

From $\lambda = 21/(21 - O_2\%)$, we get
$P_o = P_{total} \times 21(\lambda - 1)/\lambda$ Next, based on these diffusion speed $K_{MT}$ and the reaction rate $K_{CH}$, the non-combustion rate calculation section 4c calculates the non-combustion rate u. A reduction in the mass as a result of combustion is determined by integrating the char's overall combustion rate (equation (1)) over the combustion time. Hence, the non-combustion rate u for the unit mass of carbon component after the combustion time S is determined from the following formula.

$$\begin{aligned} 1-u &= -\int_0^S \frac{dm}{dt}\,dt \\ &= \int_0^S \pi D_p^2 \times 1/(1/K_{MT} + 1/K_{CH})dt \end{aligned} \quad (5)$$

Assuming the ash ratio of the raw coal to be A, the amount of unburned components for unit mass of carbon is u(1−A). Therefore, the density of in-ash unburned components C is expressed as $$C = \frac{u(1 - A)}{A + u(1 - A)} \times 100\ [\%] \quad (6)$$

The ash ratio A is the weight percentage of ash component with respect to the total weight of the coal, which is made up of four components—solid carbon, volatile substance, water and ash.

According to the in-ash unburned component density C thus obtained, the vane opening or revolution speed of the fine/coarse grain separator 13 is controlled to adjust the grain size of the powdered coal, thereby keeping the density of the in-ash unburned component in the burning waste gases within a stable range.

While in the above embodiment the "max-min logical product" method is employed as an inference method, other inference methods such as "max-min algebraic product" may be used.

With this invention, it is possible to qualitatively determine the density of in-ash unburned component in the burning waste gases with high precision by a simple means using a fuzzy inference, ensuring efficient operation of the coal-fired furnace.

Obviously, many modifications and variations of the present invention are possible in light of the above teachings. It is therefore to be understood that within the scope of the appended claims, the present invention may be practiced otherwise than as specifically described herein.

What is claimed is:

1. In a powered coal combustion furnace in which coal is pulverized by a pulverizing mill, only the powdered coal whose grain size is smaller than a specified one is extracted by a fine/coarse grain separator and the extracted powdered coal is fired in the combustion furnace, an in-ash unburned component estimating apparatus for a coal-fired furnace characterized in performing the steps of:

taking in as fuzz quantities an in-furnace temperature, a load band in the furnace, a furnace contamination coefficient, a ratio of two-stage combustion air supplied to the furnace, and a coal mixture ratio;

inferring coal-fuel ratio data and correction data used to correct predetermined reference values of reference in-furnace temperature distribution, reference in-furnace air ratio distribution and reference powdered coal grain size distribution; and based on the reference values corrected by the correction data and on coal reaction rate data determined from the coal-fuel ratio data, calculating the density of in-ash unburned components in burning exhaust gases.

2. In a powdered coal combustion furnace in which coal is pulverized by a pulverizing mill, only the powdered coal whose grain size is smaller than a specified one is extracted by a fine/coarse grain separator and the extracted powdered coal is fired in the combustion furnace, an in-ash unburned component estimating apparatus for a coal-fired furnace, comprising:

fuzzy inference means for taking in as fuzzy quantities an in-furnace temperature, a load band in the furnace, a furnace contamination coefficient, a ratio of two-stage combustion air supplied to the furnace, and a coal mixture ratio, and for inferring coal-fuel ratio data and correction data for correcting predetermined reference values of reference in-furnace temperature distribution, reference in-furnace air ratio distribution, and reference powdered coal grain size distribution;

reference means for storing said predetermined reference values of said reference in-furnace temperature distribution, said reference in-furnace air ratio distribution, and said reference powdered coal grain size distribution, and for additionally storing coal reaction rate data corresponding to said coal-fuel ratio data;

correction means for correcting said reference values output from said reference means according to the correction data output from said fuzzy inference means; and calculation means for calculating the density of in-ash unburned components based on the reference values corrected by said correction means and on the reaction rate data output from said reference means.

* * * * *